US005242314A

United States Patent [19]

Di Giulio et al.

[11] Patent Number: 5,242,314

[45] Date of Patent: Sep. 7, 1993

[54] UNIVERSAL ELECTRICAL BUS CONNECTOR

[75] Inventors: Peter C. Di Giulio, Fairfield; Kjell A. Heitmann, South Norwalk; Edward J. Naclerio, Madison, all of Conn.

[73] Assignee: Pitney Bowes Inc., Stamford, Conn.

[21] Appl. No.: 957,958

[22] Filed: Oct. 8, 1992

[51] Int. Cl.[5] ..... H01R 13/00

[52] U.S. Cl. ..... 439/404

[58] Field of Search ..... 439/389–425

[56] References Cited

U.S. PATENT DOCUMENTS

| | | | |
|---|---|---|---|
| 4,508,399 | 4/1985 | Dowling et al. | 339/17 |
| 4,581,820 | 4/1986 | Zahn et al. | 439/404 |
| 5,037,308 | 8/1991 | Bryce et al. | 439/52 |
| 5,041,007 | 8/1991 | Yu Liu et al. | 439/404 |
| 5,044,964 | 9/1991 | Minerd et al. | 439/67 |
| 5,104,336 | 4/1992 | Sinopoli | 439/404 |
| 5,125,846 | 6/1992 | Sampson et al. | 439/66 |

*Primary Examiner*—Joseph H. McGlynn
*Attorney, Agent, or Firm*—Robert H. Whisker; Melvin J. Scolnick

[57] ABSTRACT

A universal electrical bus connector is disclosed which is multi-functional in serving to connect a power and communications bus passing through the connector to a printed circuit board module to permit tapping into selected wires of the bus for utilization in the module, to connect separate power and communications buses together at any location to extend the bus within a machine harness, and to connect separate power and communications buses together at a printed circuit board module both to extend the bus and permit tapping into selected wires of the extended bus for utilization in the module. The connector includes essentially a housing having a plurality of electrical contact devices which connect between individual wires of a bus and contact areas formed on the surface of the printed circuit board module. A cover is fitted over the housing which has the effects both of tightly enclosing the wires of the bus within channels formed in the upper wall of the housing the the lower wall of the cover and causing insulation to be stripped from the wires so as to make electrical contact with the contact devices in the cover. For extending buses, two housing and cover assemblies are utilized, one for each bus, with the housings being joined in face to face relationship and with the electrical contact devices of each housing in contact with each other.

24 Claims, 12 Drawing Sheets

UNIVERSAL ELECTRICAL BUS CONNECTOR

BACKGROUND OF THE INVENTION

Field Of The Invention

The present invention relates generally to the field of electrical wire connectors, and more particularly to a universal connector for effecting electrical connection between the individual wires of a bus and either electrical contacts on a printed circuit board module or another bus, or for terminating the bus.

It has long been a conventional design practice in a large variety of product areas, such as article processing, automotive systems, factory automation and robotic systems, to utilize a single motor as the sole source of power for all of the motion control functions of the machine. The motor was typically connected, through the use of clutches, pulleys, belts, gears cams, levers and other mechanical and electro-mechanical devices, to various parts, components, and mechanisms in the machine which required motion control in order to coordinate the various functions of the machine. These devices controlled the timing of the activation of various machine functions according a predetermined sequence, and machine operation was generally satisfactory provided that no adverse condition occurred which would interrupt the normal operational cycle of the machine.

As more sophisticated motion control technology advanced, various machines evolved which were more motion control intensive, and the design trend that developed was the use of more motors and sensors acting independently but in a coordinated fashion in order to achieve higher performance functional capabilities, such as enhances throughput, more accurate motion control so as to minimize such adverse occurrences as jams, slippage and wear on materials, and greater efficiency and user convenience. Thus, the practice developed that some or all of the motion control functions of a machine would be supported by separate motors, and various types of sensors would be appropriately placed int he operational path of the machine to sense a time or conditions responsive to which a particular motor should be activated. Such a product would also include other kinds of electronic boards to support user interface(s) system expansion, interlock switches, etc. This presents a packaging challenge since there is typically little space in the motion control intensive products for these boards.

However, as these systems developed, it became apparent that the wire harnessing systems developed for these advanced products tended to be fairly difficult to deal with from the standpoints of the number of different harnesses required to support the motion control functions of the machines, the inordinate amount of circuit board module space occupied by different types of bus connectors and the difficulty of interconnecting various circuits together. Wiring systems soon became overloaded with wires emanating from a central control point out to the individual motors and sensors, with accompanying disadvantages and problems regarding serviceability, cost effectiveness, reusability and standardization of harnesses and control modules. These problems were compounded by the fact that the motion control industry appeared to be focusing on low volume, custom applications affording high mark-up and therefore little incentive to reduce motion control costs. As a result, existing motion control technology costs have prohibited its use in high volume commercial products.

In recent years, a number of communications based motion control architecture schemes have emerged in an attempt to overcome harnessing challenges and to provide a more flexible and modular environment which will substantially eliminate the various problems mentioned above. The objective of these schemes is to provide an effective communications based architecture for integrating system control elements within a product.

Prior Solutions

In typical harnessing systems as heretofore known, several wires, such as those used for power or ground, maintain their continuity around the communications loop and are tapped into at various points, while other wires, such as those used for communications data to or from motors and sensors, require interruption at each of the modules that they interface with. Thus, many wires have to be run throughout the communications loop in the machine and dual connectors at each module would have to be used. This technique adds to the cost of interconnection and reduces the reliability of the loop due to a higher interconnection count. Also, significant circuit board module area is consumed on the component side by existing connections.

Several prior solutions to these problems have been proposed. One is to run additional wires through the loop and at each module the assembler would have to cut these wires and terminate them with a standard connector that then mounts to a mating connector on the circuit board module.. The loop would be continued by coming off of the module with a second connector. This would results in twice the number of interconnections and add additional wires in the loop. Also, the end of the loop would require a special circuit board module that the end connector plugs into, or require an operator to solder together the appropriate wires to complete the communications loop. In another, the wires could be hand soldered to appropriate connections on the bottom side of the circuit board module. These solutions have been found to be unsatisfactory for several reasons; the addition of extra wire and connectors both add to the interconnection cost, and the addition of extra wires and connectors reduces the reliability of the communications circuit. Also manual operations carry a cost premium.

BRIEF SUMMARY OF THE INVENTION

The present invention seeks to obviate or eliminate the difficulties and disadvantages heretofore discussed in the use of electrical and communication harnesses in motion intensive machines which utilize multiple motors and sensors to control and coordinate the functionality of the machines.

In its broader aspects, the connector of the present invention comprises a generally rectangular housing having wall means defining opposed spaced apart substantially planar surfaces and a plurality of individual compartments within the housing. A plurality of elongate channels are formed in one of the surfaces of the housing, the channels extending laterally across the surface for receiving therein individual wires of a bus. An electrical contact means is disposed in each of the compartments and extends between the opposed surfaces, the contact means including wire retaining means and wire contact means projecting into the channels, and also having an electrical contact portion normally extending slightly beyond the opposite surface from the one in which the channels are formed. The connector also includes a generally rectangular cover having wall means defining a surface adapted to abut the surface of the housing in which the channels are formed when the housing and cover are assembled together, the cover also having a plurality of elongate channels which have a location and configuration on the cover corresponding to the channels in the housing. The cover also includes means disposed on the surface thereof adjacent the channels therein and extending toward the surface of the housing in which the channels are formed for engaging and deforming the wire retaining means as the cover and housing are assembled together to secure the wires of the bus to the wire retaining means. Finally, the connector includes means for locking the housing and cover together with the wires of the buses captured there between and in electrical contact with the electrical contact means.

In some of the more limited aspects of the invention, the electrical contact means is in the form of a resilient contact member having a generally S-shaped configuration, with a lower portion projecting beyond the lower surface of the housing to make contact with a circuit board module or other electrical device to which the lower surface of the housing is connected. The contact member has an upper flat portion which is disposed adjacent the underside of the top wall of the housing, and which has a pair of upstanding crimping tabs which project through the top wall of the housing and into the channels in the upper surface thereof, the crimping tabs being bent over the wires when the cover is assembled to the housing. The contact member also has a pair of insulation displacement contact prongs projecting upwardly from the contact member which strips away a small portion of the insulation on the wire as the wire is pressed into the space between the contact prongs when the cover is assembled to the housing.

The cover includes a plurality of wedge shaped crimping members which extend downwardly from the lower surface of the cover and are disposed between successive channels. The crimping members cut through the web between adjacent wires in the bus and bend the upwardly projecting tabs over a portion of the wires so that they are held securely between the housing and the cover. The cover also includes a longitudinally extending cutting member which projects downwardly from the lower surface of the cover and severs a plurality of wires as the cover is assembled onto the housing.

As will be seen in more detail hereinafter, the connector of the present invention was designed primarily for use with a printed circuit board module to provide low power and communications data to the module for powering such components as controllers and regulators and for controlling the timing and coordination of activation of various machine components. The connector provides the distinct advantage of permitting a large number of circuit board modules in a machine to be tied together with a single harness for operating a plurality of motors, sensors, controllers, etc., from these boards, rather than having to run individual wires or separate harnesses from a main communications board out to each individual component, which would be very difficult and costly to install and service without the connector of the his invention. Also, the unique design of the connector enables it to perform three separate connecting functions, specifically (a) tapping into certain pass through wires and severing and tapping into other non-pass through wires during assembly of the housing and cover, (b) simultaneously crimping the wires for a secure hold between the housing and cover and displacing insulation from the wires for good electrical contact during assembly of the housing and cover, and (c) providing a universal connection for any or all circuit board modules within the machine or system which require the same wire connections from the harness. This last function is particularly advantageous from the stand point that the bus connector can be mounted on either surface of any desired circuit board module where there is sufficient room to apply the required number of contact surfaces for the spring contacts in the housing, since the housing does not include any obstacles to connecting it to a flat surface.

Other advantages derived from the connector of the present invention are, firstly, that it facilitates a direct connection to the circuit board module without the need for a pin basket or other type of intermediate connecting device to mounted on the circuit board module to which a bus connector is then connected, thus permitting a substantial cost saving in circuit board design. Further, the connector of the present invention permits convenient mounting on both sides of a circuit board where physical space limitations do not permit all connectors to be mounted on the same side; all that is required is that additional contact areas be provided in a staggered relationship on opposite sides of the circuit board. Again a very substantial cost saving is realized because with the use of pin connectors on opposite sides of a circuit board, the pin connector can only be wave soldered on one side, and the pin connector on the opposite side must be hand soldered, with an additional cost factor of four to six times for each pair of opposed pin connectors as against opposed surface contacts for the connector of this invention which are done in artwork.

The utility of the present invention extends well beyond the use of the connector described above. By joining two connectors together with the lower surface of the housing of each connector in contact with the other, the spring contact members in each housing will make contact with each other so that the individual wires of a bus in one connector can be electrically connected to the corresponding wires of a bus in the other connector. Thus, several connectors can be utilized in this manner to extend the length of a complete harness indefinitely, thereby permitting the separation of the harness at convenient locations to facilitate installation changes, service or shipping.

In still another application, the connector can be used to terminate a harness by connecting it to a small special purpose circuit board module which has appropriate printed circuitry for closing the loop in all of the circuits carried by the harness, thereby eliminating the necessity of closing these loops in a circuit board module further down the line which is not normally intended to provide this function.

In an alternate embodiment of the bus connector which is intended for use solely with two separate buses, the housing and cover thereof are formed as one half components of the corresponding parts of the bus connector described above, thereby forming a connector that is identical in all respects to the connector described above except that it constitutes only a one half component of the foregoing connector. A separate bus is connected to each connector component, and the housing of each component is then connected either to a conventional circuit board module having appropriate contact surfaces thereon or to a junction circuit board that is specially designed to receive only the half components and which has contacts which will complete circuits from one bus to the other. The major advantage of this arrangement is that two separate buses or harnesses can be joined together on a conventional circuit board module, with the dual result that the connectors both extend the length of a harness and facilitate separation of the buses or harnesses at the circuit board, and also permit tapping into selected wires of the bus for connection to electronic components which are part of the circuit board module.

Having briefly described the nature and construction of the connector of the present invention, it is a principal object thereof to provide a bus connector having features of universality which render the connector multi-functional within a particular product communications architecture.

This and other objects and advantages of the present invention will become more apparent from an understanding of presently preferred embodiments of the invention when considered in conjunction with the accompanying drawings.

DETAILED DESCRIPTION OF THE INVENTION

Figure 1:
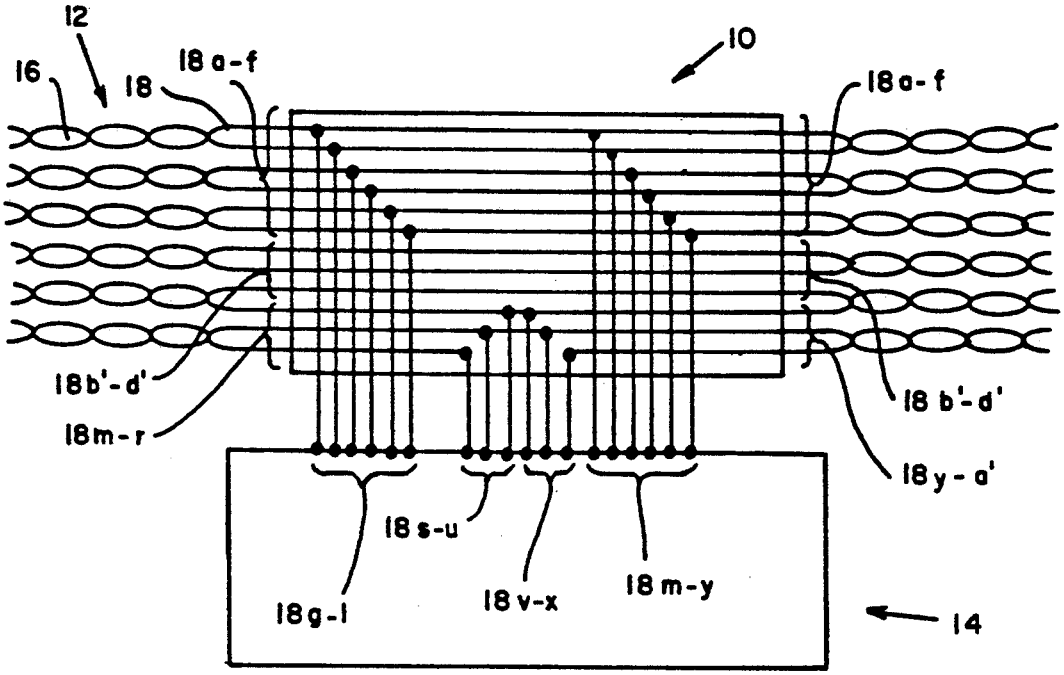
FIG. 1 is schematic view of a representative bus and a printed circuit board module to which the bus is to be connected, and illustrating the circuitry within the bus connector of the present invention which connects the individual wires of the bus to the circuit board module.

Referring now to the drawings, and particularly to FIG. 1 thereof, the bus connector of the present invention is generally designated in schematic form by the reference numeral 10, and is shown interposed between a bus generally designated by the numeral 12 and a printed circuit board module generally designated in schematic form by the numeral 14. Generally speaking, a bus is a system of wires acting in a cooperative manner so as to connect electrical printed wiring assemblies and/or electronic components. The bus wires can selectively interconnect power, serial communications, parallel communications, interlock signals, etc. among these assemblies and components. A bus harness is the manufactured assembly of a bus together with connectors, terminators and other components necessary to mount the bus harness into a machine or system. The bus 12 typically carries low power current to control various operational functions in a control module of a component, machine or system, as the case may be, and is of indefinite length, depending on the number and location of additional printed circuit boards in the components, machines or systems, the bus 12 is typically, although not necessarily, formed of portions 16 in which successive pairs of wires are twisted, and other portions 18 in which all of the wires are straight and parallel to each other. The reason for twisting successive paris of wires is to enhance noise immunity within the cable. The portions 18 where the wires are straight and parallel determines where a bus connector 10 will be located.

As mentioned above, one of the principal advantages of the bus connector of the present invention is that it can connect individual wires to a printed circuit board module either on a pass through basis of a termination basis, or it can leave certain wires unconnected to the circuit board module, all as desired. The pass through basis is illustrated by the wire group designated 18*a–f*, since these six wires are continuous in the bus 12 and extend through the connector 10, although they are also connected to the circuit board module 14 through contact members (fully described below) located in the connector 10 and which are designated in FIG. 1 as the wires 18*g–L*. In order to complete the necessary circuit for these wires, other contact members designated by the wires 18*m–r* connect between the circuit board module 14 and the continuation of the wires 18*a–f*.

The termination basis is illustrated by the wires of the bus 18 which do not pass through the connector 10, but are connected to the circuit board module 14 through contact members which are designated in FIG. 1 as the wires 18*s–u*. In order to complete the necessary circuit of these wires, other contact members designated by the wires 18*v–x* connect between the circuit board module 14 and wires 18*y–a'*, which continue on to the next successive bus connector 10.

FIG. 1 also illustrates that selected wires which pass through the connector 10 can be left unconnected to the circuit board module 14, such as the wire group designated 18*b'–d'*.

It should be understood that the black dots within the rectangle generally designated by the numeral 10 in FIG. 1 indicate the connection between the individual wires of the bus 12 and the aforementioned contact members more fully described below. Similarly, the black dots on the upper edge of the rectangle generally designated by the numeral 14 indicate the connection between the contact members and contact locations on the circuit board module, also more fully described below.

Figure 7:
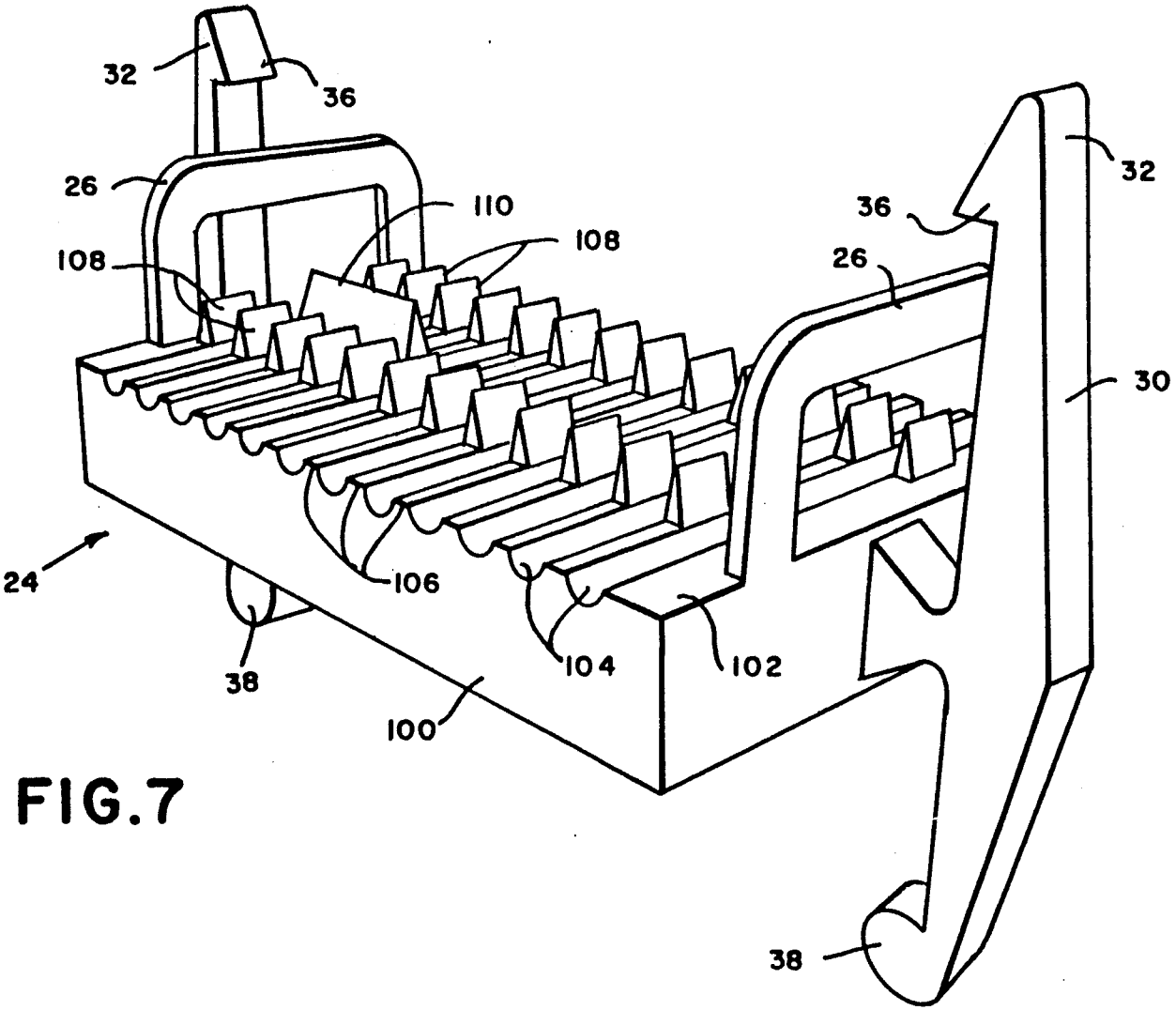
FIG. 7 is a perspective view, drawn to an enlarged scale, of the cover component of the connector shown in FIG. 2, showing the details of the lower surface of the cover.

Referring now to FIG. 1, the bus connector 10 is seen in more detail, and comprises a rectangular housing generally designated by the numeral 20 which is adapted to lie on the upper or non-component surface 22 of the circuit board module 14 and which contains all of the contact members and wire channels yet to be described. It should be understood that all references hereinafter to upper and lower walls and surfaces of the parts of the connector and the circuit board module is for convenience of illustration only, and that the actual relationship of these walls and surfaces will depend on the orientation of the connector when installed on a circuit board module within a machine. A correspondingly rectangular cover generally designated by the numeral 24 overlies the housing 20 and is attached thereto by a U-shaped clasp 26 which passes over an outwardly extending locking wedge 28 formed on two opposite sides of the housing 20. The housing 20 and cover 24 assembly is secured to the circuit board 14 by means of a pair of resilient retaining clips 30 molded into or otherwise suitably connected to opposite sides of the cover 24 just above the locking wedge 28. Each of the retaining clips 30 includes a latch portion 32 which passes through an aperture 34 in the circuit board module so that a projection 38 engages the underside of the circuit board module, and a handle portion 38 extending above the upper surface of the cover 24. This construction is also seen in FIG. 7. It will be apparent that by manually pressing the handle portion 38 of both clips 30 toward each other, the latch portion 32 moves outwardly toward the edge of the circuit board module until the projection can pass through the aperture 34, thereby releasing the entire bus and bus connector assembly from the circuit board module.

Figure 2:
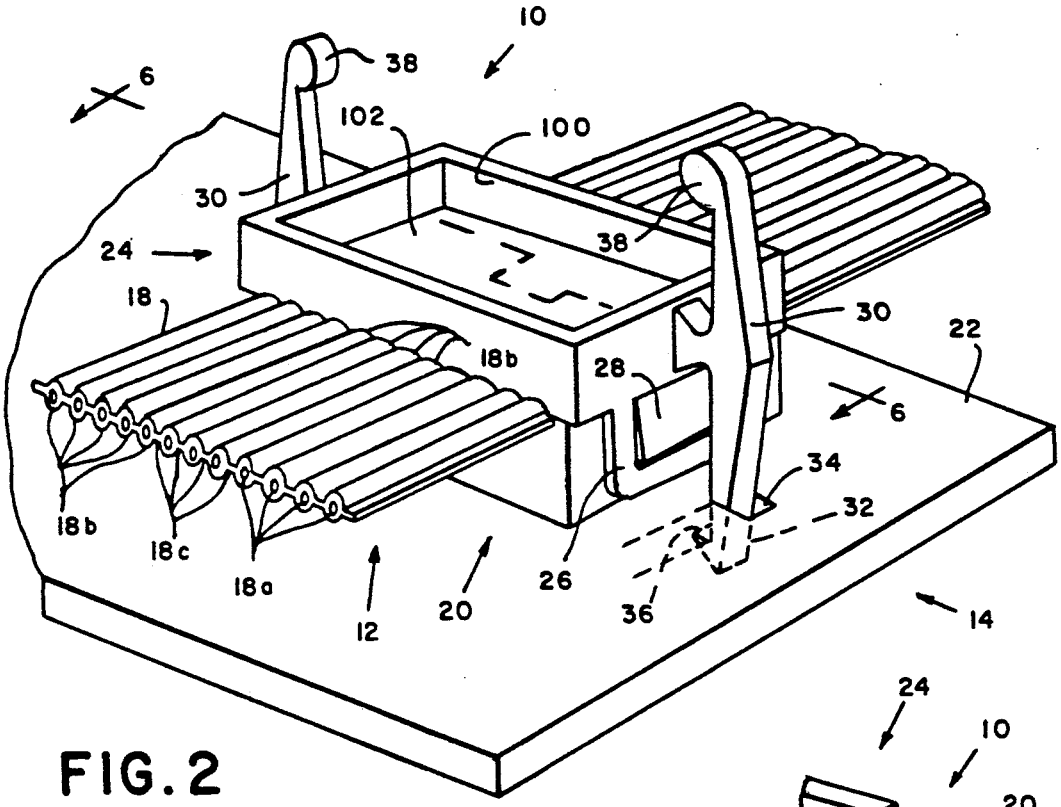
FIG. 2 is a perspective view of the assembled bus connector installed on a printed circuit board module.

FIG. 2 also illustrates further details of the flat wire portion 18 of the bus 12, which comprises a plurality of individual wires 18*a*, each of which is surrounded by a finite thickness of insulating material 18*b*, and each pair of adjacent strips of insulating material 18*b* is connected by a narrow web 18*c* of insulating material, so that the composite bus 12 is uninterrupted across its width.

Figure 3:
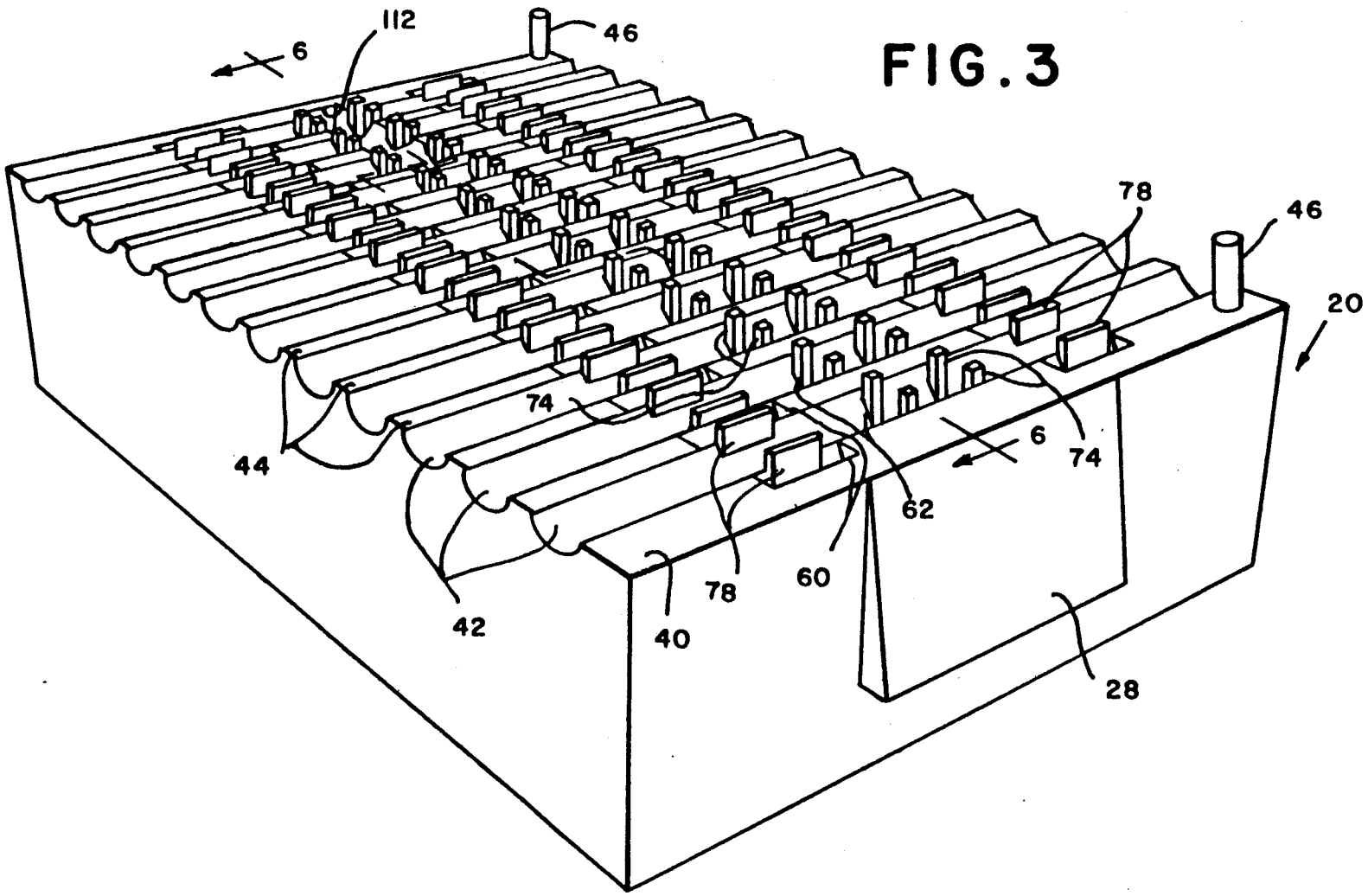
FIG. 3 is a perspective view, drawn to an enlarged scale, of the housing component of the connector shown in FIG. 2, showing the details of the upper surface of the housing.
Figure 4:
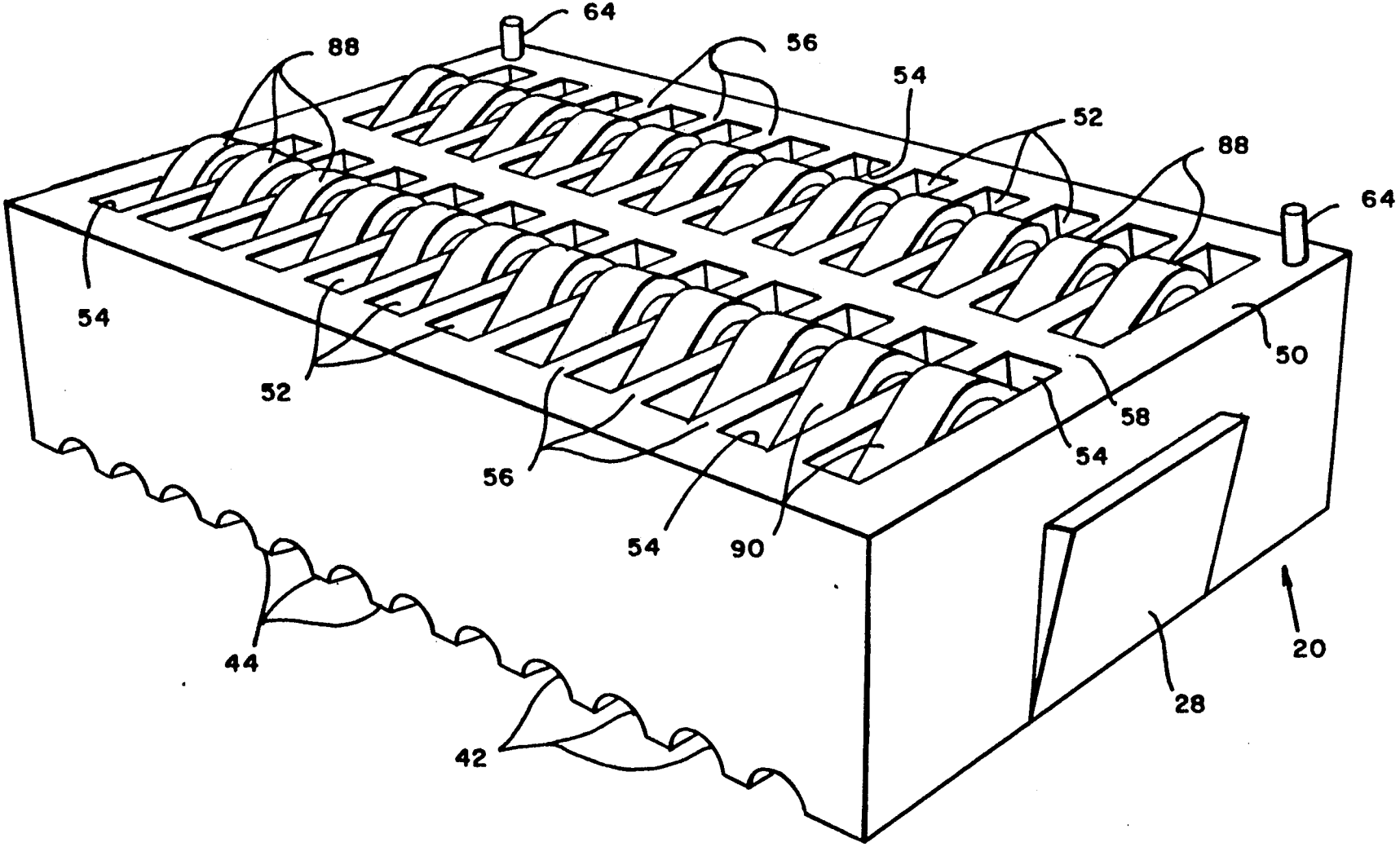
FIG. 4 is a view similar to FIG. 3, but showing the details of the lower surface of the housing.

Further details of the housing 20 are shown in FIGS. 3 and 4, FIG. 3 showing the housing in the position it normally occupies when installed on the circuit board module 14, as seen in FIG. 2, but with the cover 24 removed to show the upper bus supporting wall 40 of the housing. Thus, the upper wall 40 is provided with a plurality of elongate channels 42 which receive the individual wires 18*a*, the channels 42 being shaped to correspond to the dimensions of the insulating material 18*b*. The channels are separated by flat portions 44 of the upper wall 40 which are shaped to correspond to the webs 18*c* of the bus. Thus, the channels 42 and flat portions 44 support the flat wire portion 18 of the bus 12 when it is placed on the upper surface of the housing. The housing 20 is also provided with a plurality of pins 46 which mate with suitable holes 48 (FIG. 8) located in the lower surface of the cover in order to align properly the housing and cover when the two are assembled together as viewed in FIG. 2.

FIG. 4 shows the housing 20 in an inverted position to expose the lower surface 50 thereof, from which it is seen that the interior of the housing 20 is divided into a plurality of compartments 52 in two longitudinally extending side by side rows which are defined by the four exterior longitudinal and lateral walls 54 of the housing 20, a plurality of lateral partitions 56, and a longitudinal partition 58 which extends the full length of the housing 20. The compartments 52 open onto the surface 50 and extend upwardly to a point adjacent the upper wall 40 of the housing where the compartments 52 are partially closed by the inner surface of the wall 40 (FIG. 3), except for a plurality of apertures 60 and 62 through which certain parts of the contact members extend in the manner described below. The lower surface 50 of the housing 20 also includes a plurality of pins 64 adapted to mate with suitable holes 66 (FIG. 8) formed in the circuit board module 14 so as to align the housing on the circuit board module with greater accuracy than would be possible relying solely on the retaining clips 30.

Figure 5:
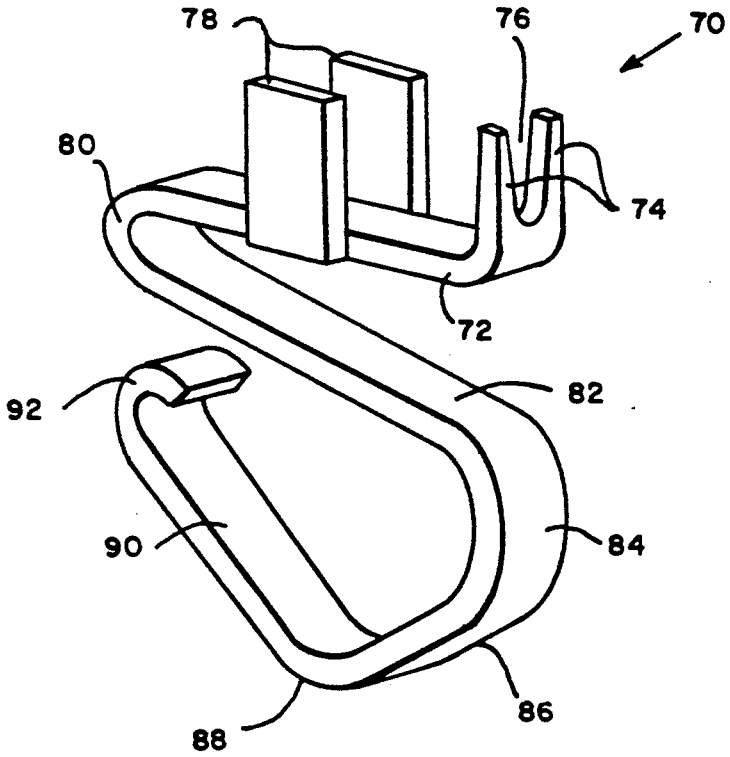
FIG. 5 is a perspective view, drawn to an enlarged scale, of one of the connecting springs mounted within the housing for making electrical connection between the bus and the circuit board module shown in FIG. 1.

Each of the compartments 52 contains a spring contact generally designated by the numeral 70 in FIG. 5. The spring contact has a generally S-shaped configuration, and comprises an upper, relatively flat segment 72 which terminates in a wire contact means defined by a pair of upstanding prongs 74 which define a recess 76 there between. The inner surfaces of the prongs 74 are slightly angled toward each other so that the recess 76 tapers inwardly but retains a curved bottom. A wire retaining means in the form of a pair of upstanding tabs 78 are connected to the flat segment 72 at approximately the midpoint thereof, the tabs extending upwardly slightly higher than the prongs 74, as bet seen in FIG. 8. The flat segment 72 terminates in a reverse curve 80, which in turn joins the flat segment 72 with another flat segment 82 of about the same length as the flat segment 72 and disposed at a slight downward angle with respect to the flat segment 72. A second reverse curve 84, which is not as sharp as the reverse curve 80, joins the second flat segment 82 with a third flat segment 86, which terminates at the lowermost point of the spring contact 70 in a relatively shallow curved portion 88 which forms a contact surface for the circuit board module as more fully described below. The curved portion 88 joins the flat segment 86 with a last flat segment 90 which extends upwardly about half of the height of the spring contact 70 and terminates in a short reverse curve 92 for a purpose explained hereinafter.

Figure 2A:
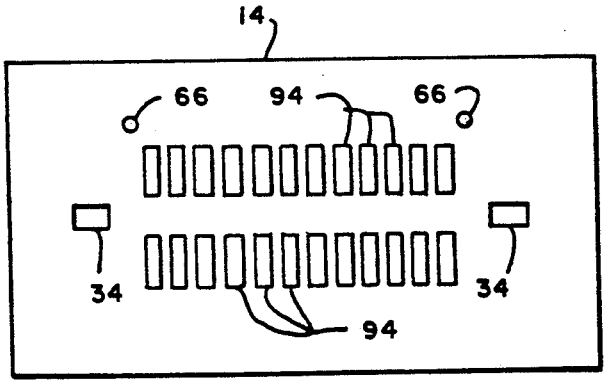
FIG. 2A is a plan view, drawn to a reduced scale, of the contact surface of the circuit board module shown in FIG. 2
Figure 8:
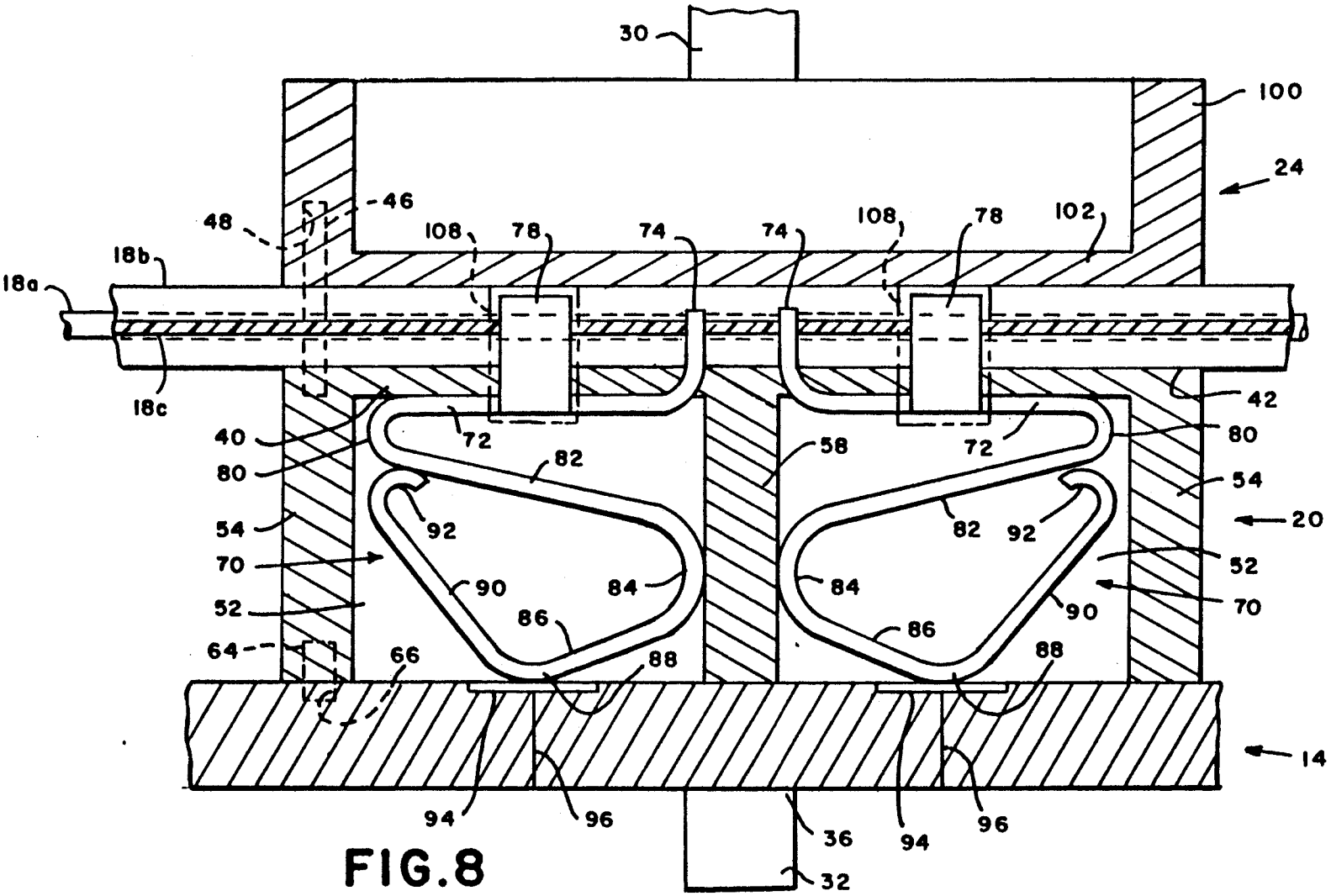
FIG. 8 is a sectional view, drawn to an enlarged scale, taken on the line 8—8 of FIG. 6.

The spring contacts 70 fit into the compartments 52 of the housing in the manner best seen in FIGS. 3, 4 and 8. Referring firstly to FIG. 8, the spring contacts 70 are shown positioned in the compartments 52, with two compartments 52 shown adjacent to each other laterally across the width of the housing 20 and being defined by the exterior walls 54 and opposite sides of the longitudinal partition 58. The spring contacts 70 fit into the compartments 52 in opposition to each other so that the pair of prongs 74 for each spring contact 70 are adjacent and the pair of tabs 78 are remote from each other. As best seen in FIG. 3, the prongs 74 extend upwardly through the apertures 62 in the upper wall 40, and the tabs 78 extend upwardly through the apertures 60 in the upper wall 40. FIG. 4 shows the curved contact surfaces 88 of the spring contacts exposed through the bottom of the compartments 52, and, as seen in FIG. 8, in contact with slags 94, which are merely small contact surfaces placed on either surface of the circuit board module in a pattern corresponding to the pattern of contact surfaces 88 of all of the spring contacts 70. FIG. 2A shows the pattern of slags 94 on the surface of the circuit board module 14 which, as seen in FIG. 4, are in contact with electronic compartments on the opposite surface of the board, as indicated schematically by the wires 96.

FIG. 8 also shows in cross-section a wire 18*a* and surrounding insulating material 18*b* positioned in one of the channels 42 formed in the upper surface 40 of the housing 20. The relationship of the parts is such that the wire 18*a* and insulating material 18*b* lie between the tabs 78 and the prongs 74 of each contact spring 70 for a purpose to be made clear hereinafter.

Referring now to FIG. 7, the cover 24 comprises an outer peripheral wall 100 and a lower wall 102 (FIG. 8) which is provided with a plurality of channels 104 which correspond in location and configuration to the channels 42 formed in the housing 20. Each of the channels 104 is separated by a flat portion 106 of the lower wall 102 which correspond in position and configuration to the fat portions 44 between the channels 42 of the housing. Thus, when the cover 24 and housing 20 are assembled as shown in FIG. 2, the opposed channels 42 and 104 of the housing and cover respectively form an encircling tube into which the wires 18*a* and insulating material 18*b* fit tightly.

Each of the flat portions 106 is provided with a pair of wedge-shaped crimping members 108 which are spaced laterally with respect to the cover 24 to correspond in location to the upstanding tabs 78 of the spring contacts 70 for a purpose to be made clear hereinafter. The cover 24 is also provided with a cutting wedge 110 located adjacent one longitudinal end of the cover 24 and, in the illustrated embodiment, spans the distance of three pairs of opposed channels 42 and 104 in the housing 20 and cover 24 respectively. When the housing and cover are assembled, the cutting wedge 110 enters a correspondingly shaped slot 112 in the upper wall of the housing (FIG. 3), again for a purpose to be made clear hereinafter. Of course, the cutting wedge 110 must be formed on an electrically insulating material which also has sufficient strength to cut through the wires disposed in the channels 42 and 104 as hereinafter described, and several such materials are known to those skilled in the art. Depending on the strength characteristics of the materials from which the cover and cutting wedge are fabricated, the cutting wedge 110 may be integrally molded with the cover 24 or it may be separately molded and suitably mounted on the cover 24.

The assembly of the connector 10 and the bus 12, together with the attachment of the connector 10 to the circuit board module 14 will now be described, with particular reference to FIGS. 2, 3, 6, 8 and 9. Although the assembly procedure is subject to some degree of variation as noted below, the procedure presently preferred is to lay the bus 12 onto the upper surface 40 of the housing 20, while it is held in the position shown in FIG. 3, with the wires 18*a* and surrounding insulation 18*b* lying loosely in the channels 42, and the web 18*c* lying over the flat portions 44. The cover 24 is then brought down on top of the bus and pressed tightly onto the cable until the clasp 26 passes over the locking wedge 28 and snaps into the position shown in FIGS. 2 and 6, after which the bus 12 is firmly gripped in the now cooperating channels 42 and 104 in the housing ad cover respectively, as seen in FIG. 2. However, a particular installer may prefer to hold the bus against the underside of the cover and bring it down onto the upper surface of the housing, and then press the cover onto the housing. The sequence of events now to be described will occur with either mode of assembly.

Figure 6:
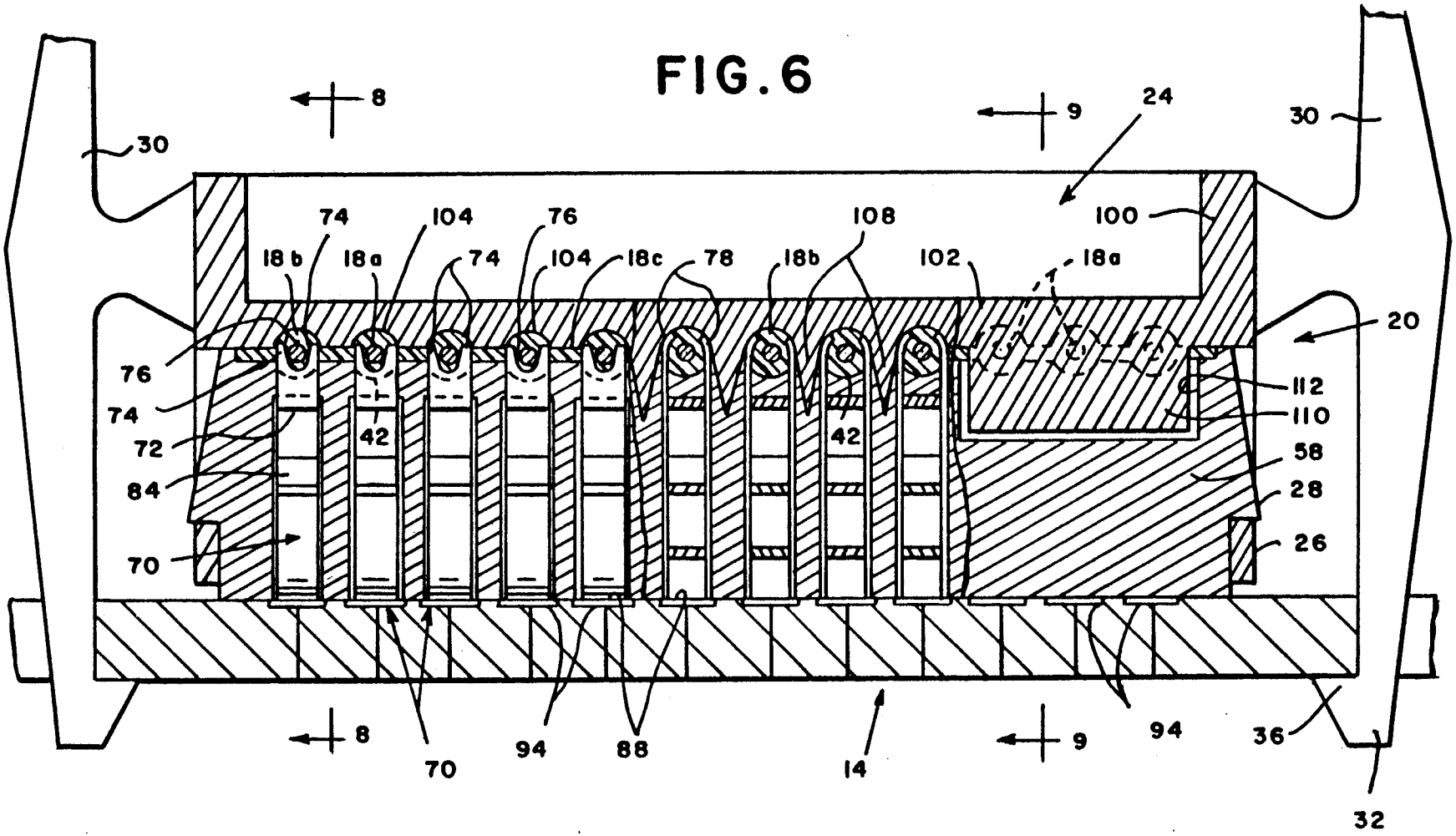
FIG. 6 is a sectional view, drawn to an enlarged scale, taken on the line 6—6 of FIGS. 2 and 3, recognizing the FIG. 3 is shown in an inverted position and must be rotated 180° clockwise to conform to the position shown in FIG. 6.
Figure 9:
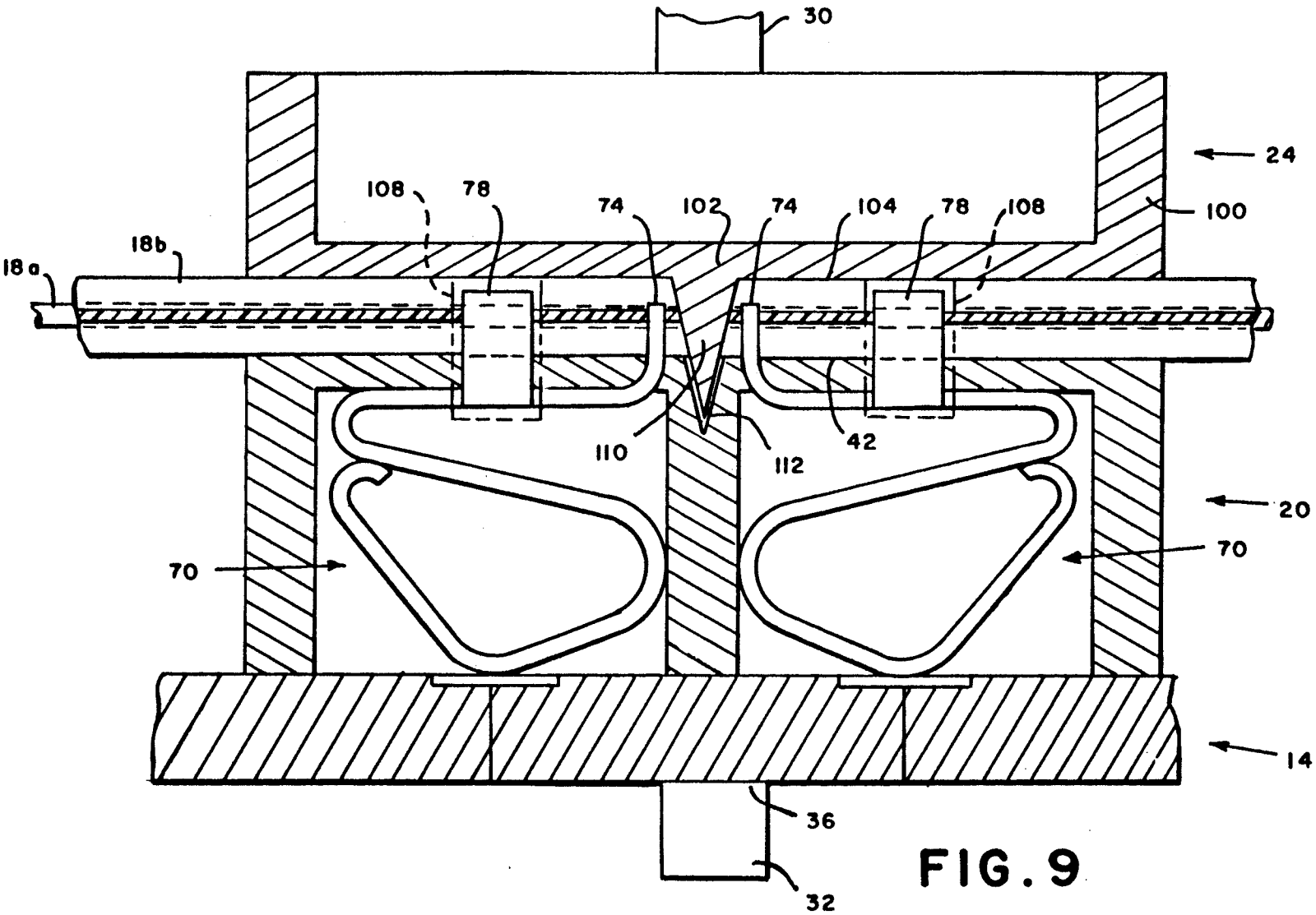
FIG. 9 is a sectional view, drawn to an enlarged scale, taken on the line 9—9 of FIG. 6.

During the assembly of the cover 24 onto the housing 20, the following sequence of events occurs. First, as best seen in FIG. 6, since the knife wedge 110 projects downwardly from the lower surface of the wall 102 of the cover 24 slightly further than the crimping wedges 108, the knife 110 severs the three wires of the bus adjacent the right end of the cable in FIG. 6 and enters the slot 112 in the housing 20. Since the slot 112 is relatively narrow, as best seen in FIG. 9, the wire assembly 18*a*, 18*b* and 18*c* is severed very cleanly because the wire assembly is resting in the channel 42 on either side of the slot 112 which prevent the ends of the wire assembly from bending downwardly when the knife wedge 110 passes through it.

The next event to occur is that the crimping wedges 108 pierce through the web portions 18*c* of the bus adjacent the crimping tabs 78 on the upper flat segment 72 of the contact members 70. As the cover member 24 moves downwardly as viewed in FIG. 6, the crimping wedges 108 gradually force each pair of crimping tabs 78 to bend inwardly toward each other so as to partially overlie the wire insulation 18*b* to forcibly hold the wires of the bus int he channels 42 of the housing 20, as best seen in FIG. 6. It should be noted that this crimping action takes place on all wires of the bus, regardless of whether they are severed as described above or allowed to pass through the connection.

The next event to occur is that the insulation 18*b* of each wire 18*a* on the bus is stripped by the insulation displacement method to afford good contact between each wire 18*a* and the contact prongs 74 on each contact member 70. As best seen in FIG. 6, the upper ends of the contact prongs 74 on each contact member 70 are separated by approximately the diameter of a wire 18*a*, so that when the bus is initially laid on top of the housing, the insulation 18*b* prevents the wires 18*a* from moving downwardly into the space 76 between the pairs of contact prongs. However, as the cover 24 is pressed onto the housing 20, the downward force exerted by the channels 104 in the cover 24 forces the wires 18*a* into the corresponding channels 42 in the housing, with the result that the insulation 18*b* which is adjacent the upper ends of the contact prongs 74 is displaced by the relatively sharp upper inner edges of the contact prongs to expose bare surfaces on opposite sides of each of the wires 18*a*. As the wires 18*a* are forced further into the spaced 76, the exposed sides of the wires make good electrical contact with the inner edges of the contact prongs 74 due to the convergence of the space 76 defined by the contact prongs.

It should be noted that the bending of the crimping tabs 78 and the stripping of the wire insulation 18*b* by the upstanding prongs 74 occur almost simultaneously, and, in fact, the above described order could even be reversed depending on the length and shape of the crimping wedges 108. It should also be noted that because of the degree of resistance offered by the wires being severed by the knife wedge 110, the web portions 18*c* of the bus being penetrated by the crimping wedges 108, the bending of the crimping tabs 78 by the crimping wedges 108 and finally the insulation displacement by the contact prongs 78, it is likely that a suitable crimping tool will be required to exert sufficient force to complete the assembly of the housing and cover.

When the connector 10 is installed onto the circuit board module 14 or other electrical device, the reverse curve 92 on the contact springs 70 contact the lower surface of the flat segment 82 so as to substantially increase the bias load of the spring contact 70 on the contact surface 88 from further deflection of the spring contact, thereby increasing the force with which the contact surface 88 presses against the slag 94 to assure good electrical contact there between.

Finally, the last event to occur in the assembly process is that the clasp 26 snaps over the locking wedge 28 to hold the cover and housing assembly together. The connector 10 is now ready to be installed on the circuit board module 14 or other electrical device.

Figure 10:
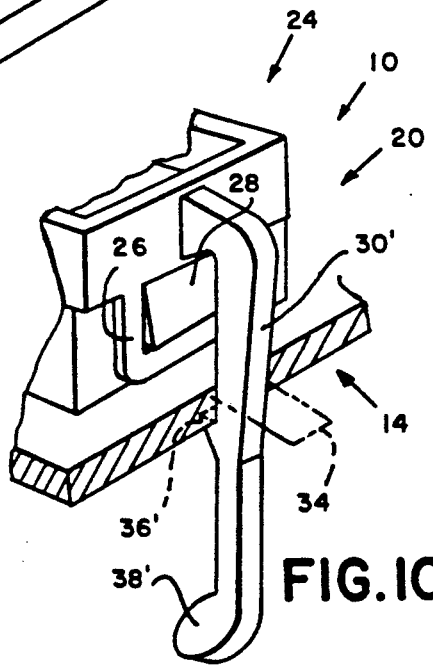
FIG. 10 is a fragmentary view of an alternate construction for mounting the connector on a circuit board module.

FIG. 10 illustrates an alternative form of mounting the connector 10 on a circuit board module. The figure shows in fragmentary form the housing 20 and the cover 24 assembled together in the same manner as seen in FIG. 2 and mounted on the circuit board 14. The difference is that the retaining clip 30' extends downwardly from the cover 24 through an aperture 34 in the circuit board 14 to handle 38' which is now disposed on the opposite side of the circuit board module 14 from the handle 38 in the FIG. 2 embodiment. A projection 36' is now disposed about midway along the retaining clip to engage the aforementioned opposite side of the circuit board module in order to securely hold the connector 10 to the other side of the board.

The difference between the two retaining clip constructions is that the arrangement shown in FIG. 2 is used in situations where the circuit board module 14 is already mounted in a machine or system component, and the connector 10 with the bus 12 already assembled is then connected to the circuit board module merely by inserting the latch portions 32 of the retaining clips through the apertures 34 in the circuit board and allowing the projections 36 to engage the lower side of the circuit board module by virtue of the inherent resiliency of the retaining clips. The handles 38 of the retaining clips must be on the same side of the circuit board as the connector 10 since the other side of the board is normally inaccessible. The arrangement shown in FIG. 10 is used in those situations where the assembly of the connector 10 and bus 12 is first attached to the circuit board module 14 and the board is then installed in the machine or system component, in which case both sides of the circuit board module are accessible.

As briefly mentioned herein above, the bus connector 10 can be utilized to connect two buses together to extend the length thereof. Thus, with reference to FIGS. 11 and 12, a pair of substantially identical bus connectors generally designated by the numerals 210 and 210' are shown stacked one on top of the other, except that the connectors are disposed in opposite orientation, i.e., if the connector 210 is viewed as right side up, the connector 210' must be viewed as upside down. The connectors 210 and 210' are substantially identical to the connector 10 previously shown and described, in that each has a housing 220 and 220' and a cover 224 and 224'. A bus 212 is captured between the housing 220 and the cover 224 in the same manner as described above in connection with the housing connector 10, the bus being secured to the electrical contact members 270 by the crimping tabs 278, and electrical contact between the wires 218*a* and the contact member 270 being accomplished through the upstanding prongs 274, all as previous described in connection with the connector 10. The second bus 212' is connected to the contact members 270' in the same manner as just described. It will be apparent that electrical contact between the two buses is affected through the adjacent contact portions 288 and 288' of each abutting pair of contact members 270 and 270'. It should be noted that the covers 224 and 224' of the variant of the invention do not include a severing means such as the knife 110 of the covers 24 since it is desired to connect together all of the wires of the buses 218 and 218'

Figure 11:
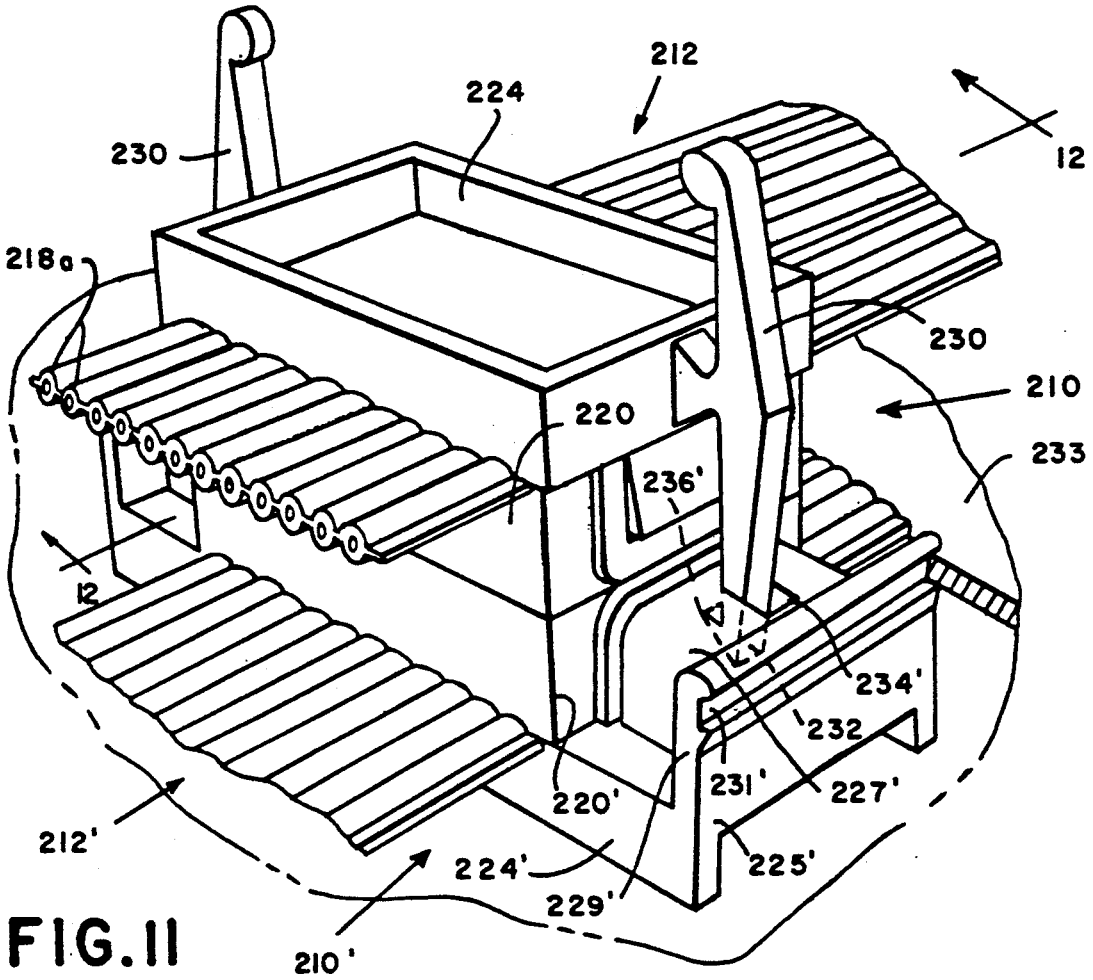
FIG. 11 is a perspective view similar to FIG. 2 showing the manner in which the connector of the present invention can be utilized to connect two buses together, rather than to a circuit board module.
Figure 12:
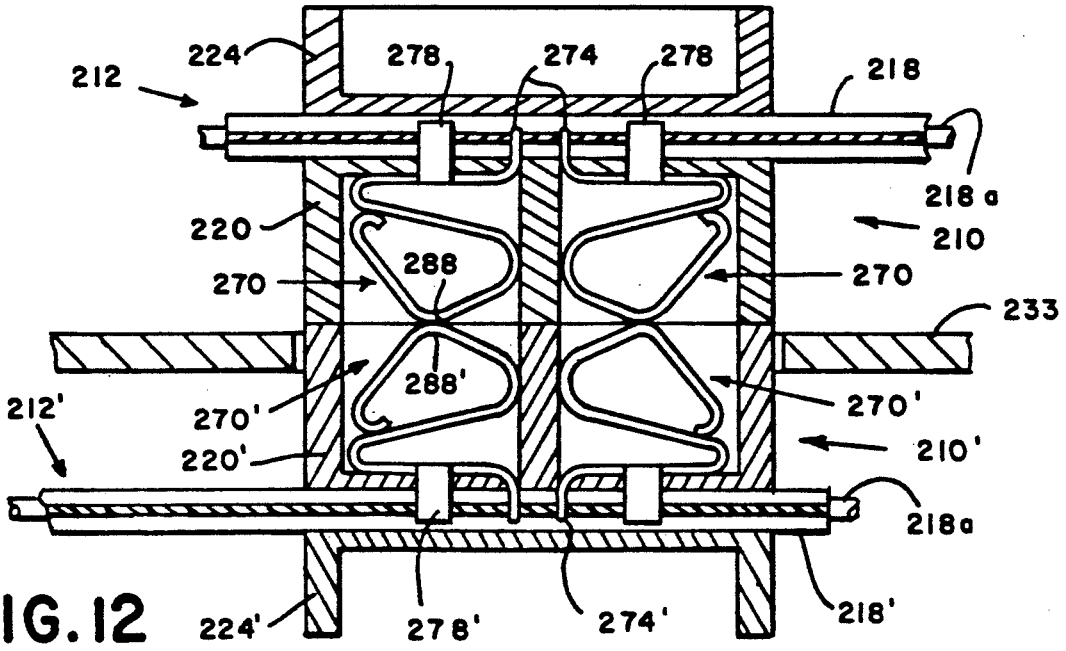
FIG. 12 is sectional view taken on the line 12—12 of FIG. 11.

One significant difference between the covers of this embodiment and the cover 24 of the previous embodiment is that one of the covers of this embodiment, the cover 224' in the arrangement shown in FIG. 11, is provided with a longitudinal extension 225' which extends outwardly beyond the end wall of the housing 220'. The extension 225' provides support for an elevated wall 227' which is disposed at the same height that a circuit board module would occupy if the upper connector 210 were to be attached to the circuit board module. The wall 227' is provided with an aperture 234' through which the latch portion 232 of a resilient retaining clip 230 extends so that the projection 236 can engage with the lower surface of the wall 227' in the same manner as illustrated in FIG. 2 and described above. Thus, the wall 227' is a substitute for, and performs the same function as, a circuit board module. The extension 225' is also has an upstanding outer end wall 229', the upper portion of which is provided with a lateral groove 231'. This groove, and the corresponding groove on the other end of the lower cover 224', provide a convenient means by which the entire device can be mounted on a panel or other suitable holding device, as indicated by the numeral 233.

Figure 13:
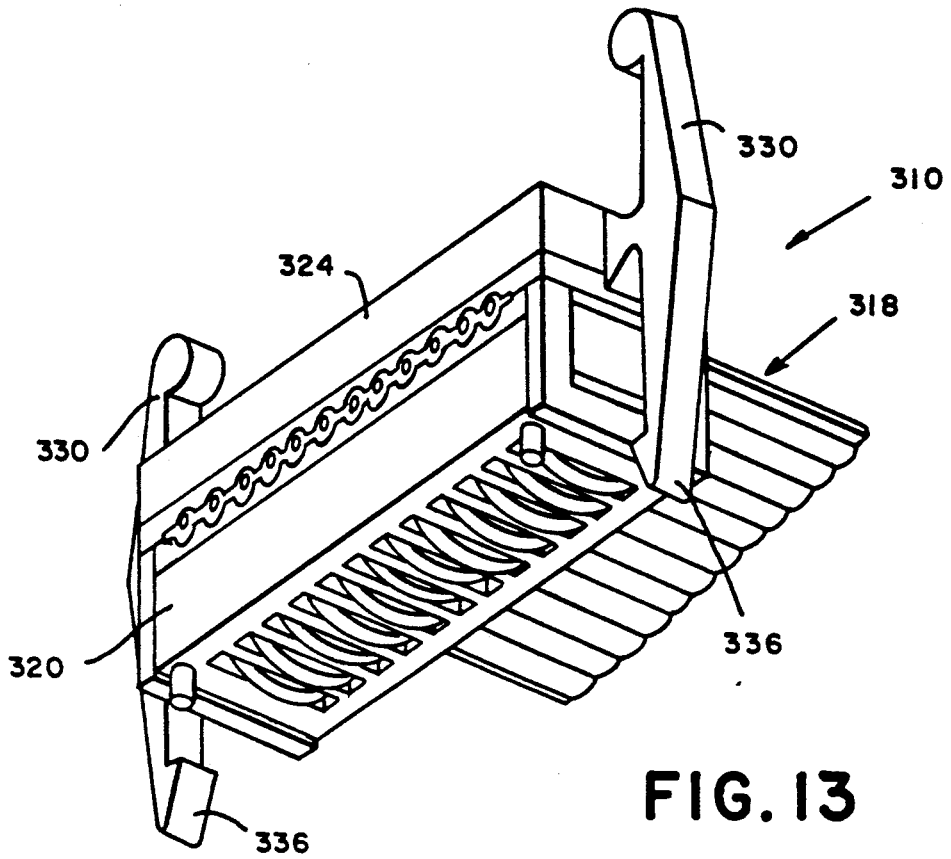
FIG. 13 is a perspective view, drawn to a reduced scale, of an alternative embodiment of the invention in which the bus connector of the previous embodiment is split in half and each half is utilized to connect a bus to a circuit board module, viewing the connector from below.
Figure 14:
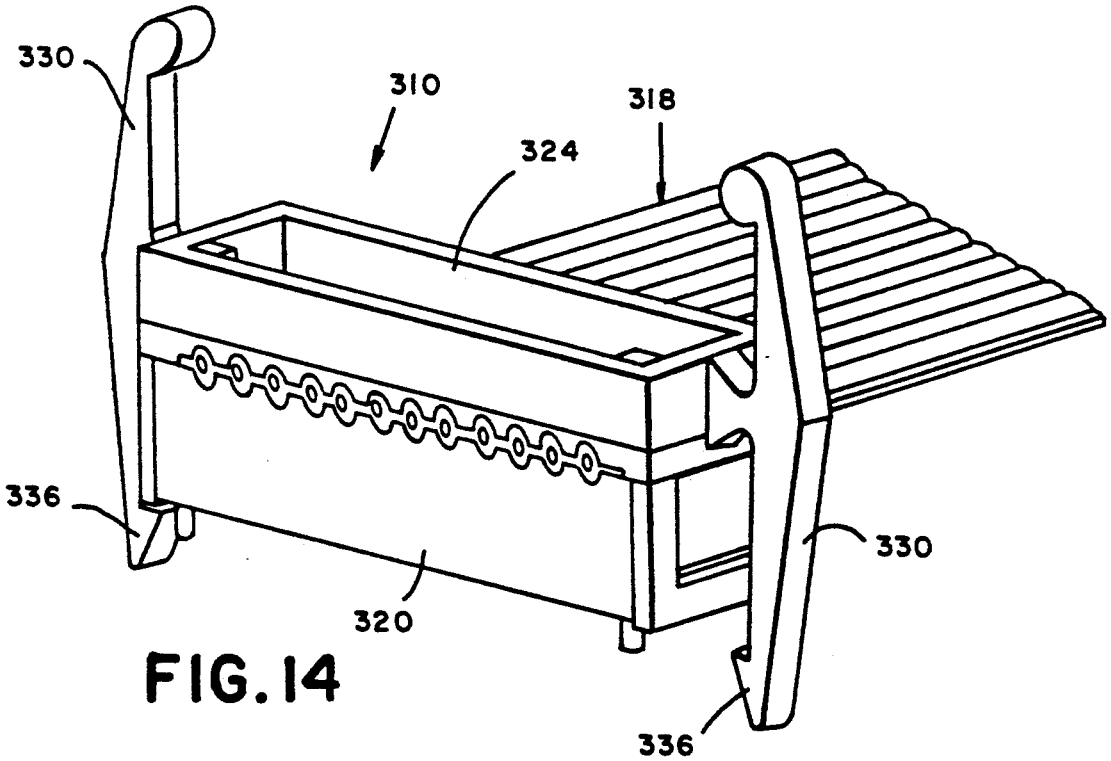
FIG. 14 is a view similar to FIG. 13, viewing the connector from above.
Figure 15:
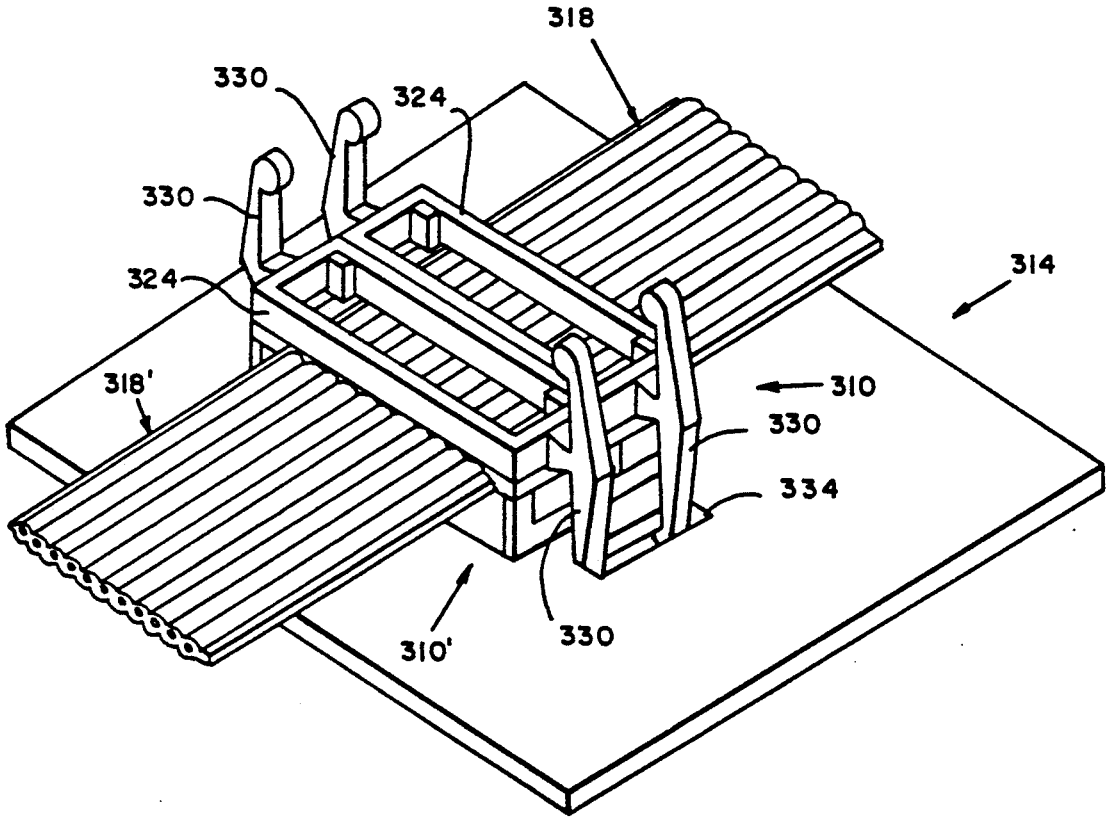
FIG. 15 is a perspective view showing the modified bus connectors of FIGS. 13 and 14 being used to connect two buses together by mounting on a conventional circuit board module.

FIGS. 13, 14 and 15 illustrate another embodiment of the bus connector of the present invention which is intended for use solely to join two separate buses together, either through a conventional circuit board module or through a specially designed junction circuit board. The primary advantage of this embodiment over the previous embodiment is that when the separate buses are joined through a conventional circuit board, individual wires of the bus can be tapped and connected to various electronic components on the circuit board module, which is not possible with the bus connector of the previous embodying when it is used to joint two buses together in the manner illustrated in FIG. 11 because there is no intervening circuit board.

Referring now to the figures, a bus connector, generally designated by the reference numeral 310 comprises a housing 320 and a cover 324 which are substantial duplicates in all respects of the housing 20 and cover 24 of the previous embodiment except for the differences specifically described below. The housing and cover enclose, and connect to, the individual wires of a bus 318, and the assembled connector is connected to a circuit board module 314 by the same type of resilient retaining clips 330 as the clips 30 of the previous embodiment which have projections 336 extending through apertures 334 in the circuit board module to secure the bus connector to the circuit board. As seen in FIG. 15, two identical connectors 310 are mounted on the circuit board module 314 in side by side relationship, and the apertures 334 are elongated so that the projections 336 of adjacent retaining clips 330 can pass through the same aperture, although two separate apertures could be provided if desired.

Figure 16:
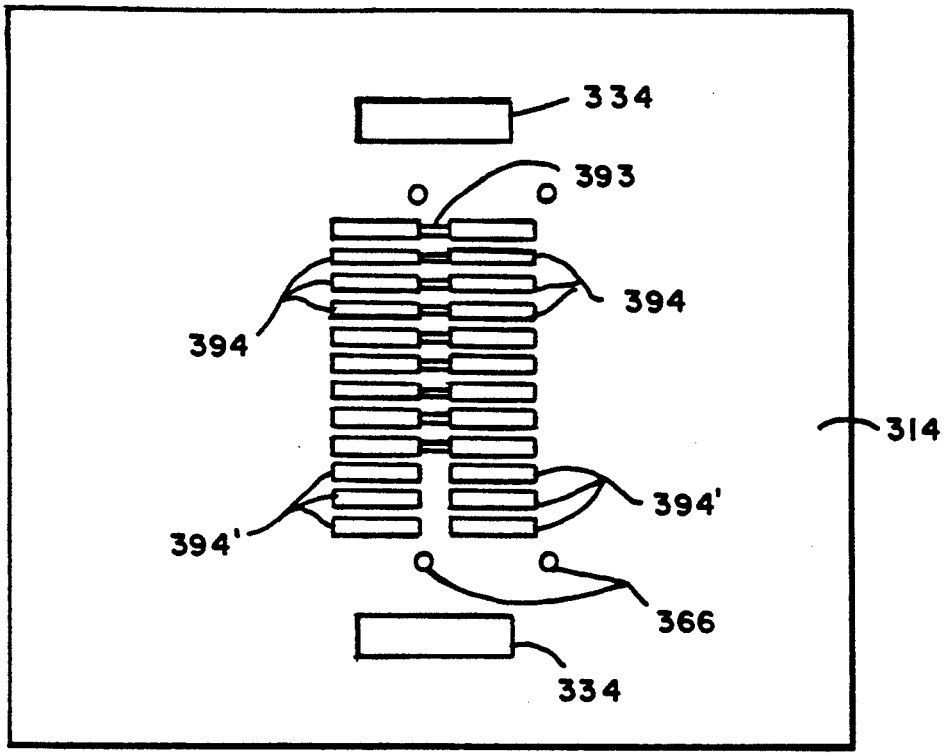
FIG. 16 is a plan view, similar to FIG. 2A, of the contact surface of a circuit board module modified for use with the bus connector of this embodiment.

FIG. 16 illustrates the slag pattern which must be placed on the circuit board 314 to accommodate the bus connectors 310 and 310' of this embodiment of the invention. By comparison of FIG. 16 with FIG. 2A, it will be seen that the major difference between the slag patterns is that each slag of the nine adjacent pairs of slags labeled 394 are connected by connecting strips 393 so that the slags of each pair are electrically connected. By providing the connecting strips 393, a circuit is provided through both bus connectors 310 and 310' and the circuit board 314 for the wires of the buses 318 and 318' which are intended to pass through all connectors from one end of the harness to the other. It will be noticed that the three pairs of slags labeled 394' are not connected by connecting strips, thereby effectively terminating the wires of the bus at the circuit board which are intended not to pass there through, in the same manner as those which are severed by the knife 110 in the bus connector 10 when connected to the circuit board module 14.

From the foregoing, it is apparent that the bus connectors 310 and 310' are used with separate buses to connect them together at a conventional circuit board module so as to extend the length of the harness, while at the same time permitting tapping into selected wires of the buses to connect them to various electronic components on the circuit board module. This arrangement also facilitates disconnecting individual buses from the circuit board modules for convenience of rearrangement of components, servicing and shipping. However, another advantage of the slag pattern of the circuit board module shown in FIG. 16 is that both the bus connector 10 and the bus connectors 310 and 310' can be used with this circuit board arrangement, thereby permitting one type of board construction to be used with both types of bus connectors to reduce the number of parts which must be maintained.

Figure 17:
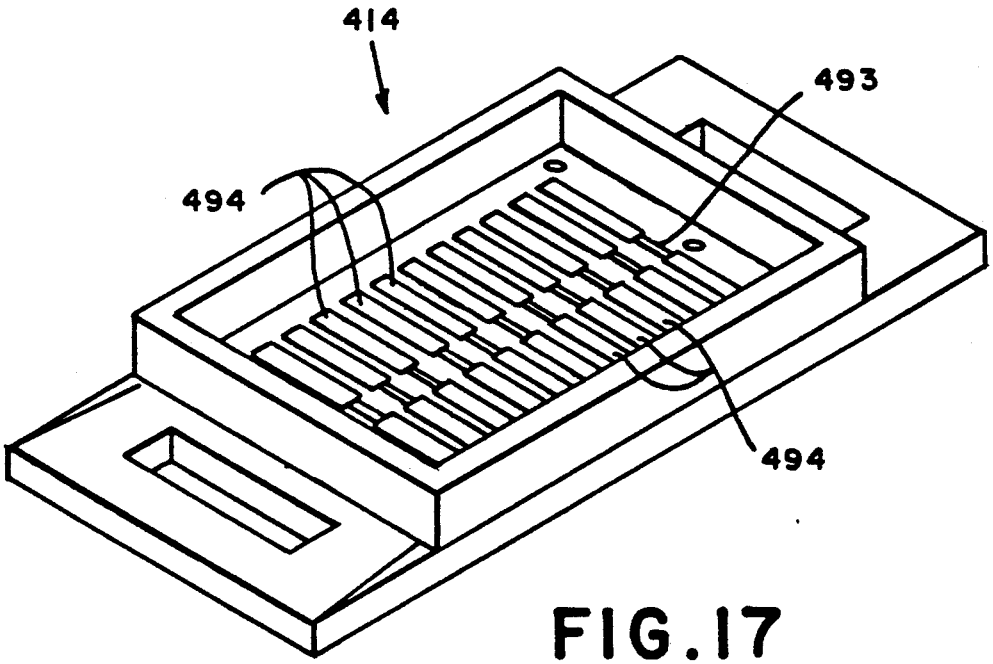
FIG. 17 is a perspective view of a junction circuit board with which the bus connectors shown in FIGS. 13 and 14 can be used merely to join two buses together.

FIG. 17 illustrates a form of jumper board which can be used with the bus connectors 310 and 310' just described in those situations where it is desired only to join adjacent buses together with the necessity for tapping into any wires or terminating any at a circuit board module. Thus, the jumper board, generally designated by the number 414, is a simulated circuit board which contains nothing more than the pairs of adjacent slags 494; both slags of all of the pairs are connected by connecting strips 493. Thus, when two bus connectors are connected to the jumper board 414 in the same manner as shown in FIG. 15, all of the wires of both buses are connected together through the jumper board. Other advantages of the jumper board are than can be used to close the open bottom of the housing components to keep the electrical contact means of the housings clean and prevents the possibility of short circuiting during assembly and handling of harnesses, and facilitates harness assembly for servicing and shipping when no connections to a circuit board module are required at that location.

It should be noted, in connection with the principles of the present invention, that there are situations where it is disadvantageous to connect the housing directly to the surface of a circuit board module using the spring contacts disclosed above. In these situations, it is contemplated that the housing and electrical contact members therein would be modified so that the contact members would engage with contact tabs which would project outwardly from an edge of the circuit board module and would be held in firm contact therewith by appropriate connecting the housing to the modified circuit board module.

What is claimed is:

1. A bus connector for connecting selected wires of a bus passing through said bus connector to a printed circuit board module having a plurality of electrical contacts formed on a surface thereof which are to be electrically connected to the selected wires of a bus, the electrical contacts being formed in two parallel rows of adjacent pairs of contacts, said bus connector comprising:

A. a generally rectangular housing, said housing having
   1. wall means defining opposed spaced part substantially planar surfaces of said housing and a plurality of individual compartments within said housing which open on one of said surfaces,
   2. a first plurality of elongate channels formed in the other of said surfaces, said channels extending laterally across said other surface for receiving therein the individual wires of a bus, and
   3. electrical contact means disposed in each of said compartments and extending through said housing between said surfaces, said electrical contact means having wire retaining means and wire contact means projecting into said channels in said other surface, and having an electrical contact portion normally extending slightly beyond said one surface, B. a generally rectangular cover, said cover having
   1. wall means defining a surface adapted to abut said other surface of said housing when said housing and said cover are assembled together,
   2. a second plurality of elongate channels formed in said surface, said channels extending laterally across said surface and having a location and configuration corresponding to said first plurality of channels in said housing, and
   3. means disposed on said surface of said cover adjacent said channels and extending toward said other surface of said housing for securing the wires of the bus to said wire retaining means, C. means cooperatively associated with said housing and said cover for locking said housing and said cover together with the wires of the bus captured there between and in electrical contact with said wire contact means, and D. means for connecting said bus connector to the surface of the printed circuit board module having the plurality of electrical contacts thereon with said compartments of said housing overflying the electrical contacts, whereby said bus connector conducts electrical signals from the individual wires of the bus through said electrical contact means to the electrical contacts on the surface of the printed circuit board module.

2. A bus connector as set forth in claim 1 wherein said means for locking said housing and said cover together comprises a pair of fixed locking members mounted on opposite walls of either said housing or said cover, and a pair of cooperating resilient locking members mounted on corresponding opposite walls said cover or said housing respectively, said resilient locking members adapted to releasable lock onto said fixed locking members when said housing and said cover have been pressed firmly together.

3. A bus connector as set forth in claim 1 wherein said wall means defining said compartments comprises opposed exterior longitudinal and lateral walls which extend from said one surface toward said other surface, an upper wall contiguous with said exterior walls and which defines said other surface, an interior longitudinal wall extending the length of said housing, and a plurality of parallel, spaced apart interior lateral walls, all of said walls cooperating to define two longitudinally extending side by side rows of spaced apart pairs of laterally adjacent compartments.

4. A bus connector as set forth in claim 3 wherein said first plurality of channels are spaced apart corresponding to the spacing of said compartments so that said channels overlie said paris of compartments.

5. A bus connector as set forth in claim 4 wherein said electrical contact means comprises a resilient contact member disposed in each of said compartments, each contact member having said wire retaining means and said wire contact means projecting through said upper wall and into one of said channels.

6. A bus connector as set forth in claim 5 wherein each of said resilient contact members comprises a generally S-shaped member having an upper flat segment adjacent the lower surface of said upper wall and extending substantially the length of said compartment containing said contact member, said flat segment supporting said wire retaining means and said wire contact means.

7. A bus connector as set forth in claim 6 wherein said wire retaining means comprises a pair of upstanding tabs spaced along said flat segment of said member for forcibly gripping a wire when said tabs are bent inwardly and over said wire.

8. A bus connector as set forth in claim 7 wherein said means for securing the wires of the bus to said wire retaining means comprises means projecting downwardly from said surface of said cover for engaging and deforming said pairs of upstanding tabs as said cover and said housing are assembled together.

9. A bus connector as set forth in claim 8 wherein said downwardly projecting means comprises a plurality of wedge shaped members disposed on said surface of said cover between adjacent channels of said second plurality of channels and in lateral juxtaposition to said pairs of upstanding tabs on said electrical contact means so as to contact adjacent tabs of successively adjacent pairs of tabs to bend said adjacent tabs in opposite directions over adjacent wires as said cover is pressed onto said housing.

10. A bus connector as set forth in claim 6 wherein said wire contact means comprises a pair of upstanding wire engaging prongs disposed at the end of said flat segment and projecting upwardly through said top wall of said housing and into the channel which overlies the compartment containing said contact member.

11. A bus connector as set forth in claim 10 wherein the upper end said upstanding prongs are spaced apart by approximately the diameter of a wire and are slanted toward one another from the outer end of said prongs so that said prongs strip the insulation from the wire and firmly contact the wire as the wire is forced into the space between said prongs by said second plurality of channels in said cover as said cover and said housing are pressed together.

12. A bus connector as set forth in claim 6 wherein said electrical contact portion of said electrical contact means comprise a lower curved portion of said S-shaped member extending out of the opening is said housing and projecting beyond said one surface of said housing whereby said curved portion is pressed against the surface of an electrical device on which said bus connector is mounted.

13. A bus connector as set forth in claim 12 wherein said S-shaped member includes a terminal portion normally disposed adjacent an intermediate segment which connects said upper flat segment and said lower curved portion, said terminal portion being adapted to press against said intermediate segment as said S-shaped member is compressed when said bus connector is mounted on the surface of said electrical device.

14. A bus connector as set forth in claim 1 wherein said cover further includes means disposed on said surface of said cover and extending toward said other surface of said housing for severing selected wires of the bus during assembly of said housing and said cover.

15. A bus connector as set forth in claim 14 wherein said means for severing selected wires of the bus comprises cutting means projecting downwardly from said surface of said cover, said cutting means being disposed on said cover in alignment with said interior longitudinal wall of said housing so that the wires disposed in said first plurality of channels are severed approximately at the lateral midpoint of said housing.

16. A bus connector as set forth in claim 15 wherein said interior longitudinal wall includes a recess disposed therein in opposed relationship to said cutting means on said cover to facilitate complete severing of said wires during assembly of said housing and said cover.

17. A bus connector as set forth in claim 1 wherein said means for connecting said bus connector to the surface of the electrical device comprises a pair of elongate resilient retaining clips mounted on opposite walls of said cover and extending above and below said cover, said retaining clips having latch portions at the lower ends thereof which project through apertures formed int he electrical device so that said latch portions engage the lower surface of the electrical device to hold said bus connector securely onto the upper surface of the electrical device.

18. A bus connector as set forth in claim 17 wherein said retaining clips have handle portions at the upper ends thereof for manual grasping to squeeze said manual engaging portions toward each other to release said latch portions from the under side of the electrical device to release said bus connector therefrom.

19. A bus connector as set forth in claim 1 wherein said means for connecting said bus connector to the surface of the electrical device comprises a pair of elongate resilient retaining clips mounted on opposite walls of said cover and extending downwardly from said cover through apertures formed in the electrical device, said retaining clips having latch portions formed intermediate said cover and the lower end of said retaining clips which engage the lower surface of the electrical device to hold said bus connector securely onto the upper surface of the electrical device.

20. A bus connector as set forth in claim 19 wherein said retaining clips have handle portions at the lower ends thereof for manual grasping to urge said handle portions away from each other to release said latch portions from the under side of the electrical device to release said bus connector therefrom.

21. A bus connector for joining the wires of two buses together to form a single bus, said bus connector comprising:

A. a pair of substantially identical generally rectangular housings, each of said housings having
   1. wall means defining opposed spaced part substantially planar surfaces of said housing and a plurality of individual compartments within said housing which open on one of said surfaces,
   2. a first plurality of elongate channels formed in the other of said surfaces, said channels extending laterally across said other surface for receiving therein the individual wires of a bus,
   3. electrical contact means disposed in each of said compartments and extending through said housing between said surfaces, said electrical contact means having wire retaining means and wire contact means projecting into said channels in said other surface, and having an electrical contact portion normally extending slightly beyond said one surface, and
   4. said housings normally being disposed with said one surface of said housings being in abutting face to face relationship and said electrical contact portions in contact with each other, B. a pair of substantially identical generally rectangular covers, each of said covers having
   1. wall means defining a surface adapted to abut said other surface of said housing when said housing and said cover are assembled together,
   2. a second plurality of elongate channels formed in said surface, said channels extending laterally across said surface and having a location and configuration corresponding to said first plurality of channels in said housing, and
   3. means disposed on said surface of said cover adjacent said channels and extending toward said other surface of said housing for securing the wires of the bus to said wire retaining means, C. means cooperatively associated with said housing and said covers for locking said housings and said covers together with the wires of each bus captured between one of said housings and one of said covers and with the wires of each bus in electrical contact with said wire contact means of each respective housing, and D. means for connecting said housings together in said abutting fact to face relationship with said covers locked thereon, whereby the wires of one of said buses are in electrical contact with the corresponding wires of the other bus through said electrical contact means in each of said housing so as to connect the buses together to form a single extended bus.

22. A bus connector as set forth in claim 21 wherein said means for connecting said bus connectors together comprises a pair of elongate resilient retaining clips mounted on opposite walls of said cover of one of said bus connectors and extending toward said other bus connector, said retaining clips having latch portions at the ends thereof adapted to engage the cover of said other bus connector to hold both said bus connectors together with said electrical contact means of each bus connector in contact therewith.

23. A bus connector as set forth in claim 22 wherein said cover of said other bus connector includes longitudinal extensions formed on opposite walls thereof corresponding to the walls of said cover of said one bus connector, said extensions having apertures therein through which said latch portions of said retaining clips extend to as to engage the underside of said extensions when said bus connectors are assembled together when said one surface of each bus connector in contact with the other.

24. A bus connector for joining selected wires of two buses together through a printed circuit board module having a plurality of electrical contacts formed on a surface thereof which are to be electrically connected to the selected wires of the bus, the electrical contacts being formed in two parallel rows of adjacent pairs of contacts and with the contacts of selected pairs being electrically connected, said bus connector comprising:

A. a pair of substantially identical generally rectangular housings, each of said housings having
   1. wall means defining opposed spaced part substantially planar surfaces of said housing and a plurality of individual compartments within said housing which open on one of said surfaces,
   2. a first plurality of elongate channels formed in the other of said surfaces, said channels extending laterally across said other surface for receiving therein the individual wires of a bus, and
   3. electrical contact means disposed in each of said compartments and extending through said housing between said surfaces, said electrical contact means having wire retaining means and wire contact means projecting into said channels in said other surface, and having an electrical contact portion normally extending slightly beyond said one surface, and B. a pair of substantially identical generally rectangular covers, each of said covers having
   1. wall means defining a surface adapted to abut said other surface of said housing when said housing and said cover are assembled together,
   2. a second plurality of elongate channels formed in said surface, said channels extending laterally across said surface and having a location and configuration corresponding to said first plurality of channels in said housing, and
   3. means disposed on said surface of said cover adjacent said channels and extending toward said other surface of said housing for securing the wires of the bus to said wire retaining means, C. means cooperatively associated with said housing and said covers for locking said housings and said covers together with the wires of each bus captured between one of said housings and one of said covers and with the wires of each bus in electrical contact with said wire contact means of each respective housing, and D. means for connecting said housings to the surface of the printed circuit board module having the electrical contacts thereon in side by side relationship with said compartments of each housing overlying one of the rows of electrical contacts so that said electrical contact portions extending beyond said one surface of each housing are in contact with the electrical contacts in one of said parallel rows thereof, whereby the wires of both buses are electrically connected through the selected pairs of electrical contacts which are connected together, and all of the wires of both buses are can be tapped into for connection to utility components mounted on the printed circuit board module.

* * * * *